US008094826B2

(12) United States Patent
Pedersen

(10) Patent No.: US 8,094,826 B2
(45) Date of Patent: Jan. 10, 2012

(54) METHOD AND SYSTEM FOR EQUALIZING A LOUDSPEAKER IN A ROOM

(75) Inventor: Jan Abildgaard Pedersen, Holstebro (DK)

(73) Assignee: SL Audio A/S, Skive (DK)

( * ) Notice: Subject to any disclaimer, the term of this patent is extended or adjusted under 35 U.S.C. 154(b) by 750 days.

(21) Appl. No.: 12/159,897

(22) PCT Filed: Dec. 19, 2006

(86) PCT No.: PCT/DK2006/000724

§ 371 (c)(1),
(2), (4) Date: Oct. 21, 2008

(87) PCT Pub. No.: WO2007/076863

PCT Pub. Date: Jul. 12, 2007

(65) Prior Publication Data

US 2009/0274309 A1 Nov. 5, 2009

(30) Foreign Application Priority Data

Jan. 3, 2006 (DK) ..... 2006 00008

(51) Int. Cl.
*H04R 29/00* (2006.01)

(52) U.S. Cl. ..... 381/58; 381/96; 381/103

(58) Field of Classification Search ..... 381/58, 381/96, 103

See application file for complete search history.

(56) References Cited

U.S. PATENT DOCUMENTS

| | | | | |
|---|---|---|---|---|
| 4,458,362 | A | 7/1984 | Berkovitz et al. | |
| 6,721,428 | B1 * | 4/2004 | Allred et al. | 381/103 |
| 6,760,451 | B1 | 7/2004 | Craven et al. | |
| 2005/0094821 | A1 | 5/2005 | Bharitkar et al. | |

FOREIGN PATENT DOCUMENTS

| | | | |
|---|---|---|---|
| EP | 0 772 374 | A2 | 5/1997 |
| EP | 1 475 996 | A1 | 11/2004 |
| EP | 1 523 221 | A2 | 4/2005 |
| JP | 2000-261900 | | 9/2000 |
| JP | 2005-167498 | | 6/2005 |

* cited by examiner

*Primary Examiner* — Minh-Loan T Tran

(74) *Attorney, Agent, or Firm* — Stephen A. Bent; Foley & Lardner LLP

(57) ABSTRACT

Disclosed is a method for equalizing a first loudspeaker positioned in a room in order to compensate for an influence of the room, the method comprising the steps of 1) measuring a listening position transfer function from electrical input of the first loudspeaker to a sound pressure at a listening position in the room, 2) determining a global transfer function representing a spatial average of sound pressure level in the room generated by the first loudspeaker, 3) determining an upper gain limit as a function of frequency, the upper gain limit being based on an inverse of the global transfer function, 4) determining an equalizing filter based on an inverse of the listening position transfer function, wherein a gain of the equalizing filter is limited to a maximum gain in accordance with the upper gain limit, and 5) equalizing the first loudspeaker according to the equalizing filter.

55 Claims, 7 Drawing Sheets

METHOD AND SYSTEM FOR EQUALIZING A LOUDSPEAKER IN A ROOM

FIELD OF THE INVENTION

The invention relates to the field of audio and sound reproduction equipment, more specifically the invention provides a method and a system for equalizing a loudspeaker in a room with the purpose of adapting the loudspeaker to the room and thus improve sound reproduction. More specifically, the equalizing is intended to correct a frequency characteristics perceived in a listening position in the room in order to obtain a sound reproduction with a perceived neutral timbre which is more independent of room characteristics, loudspeaker position and listening position in the room.

BACKGROUND OF THE INVENTION

Within the field of audio reproduction, such as hi-fi stereo or surround sound systems for home use, it is well-known to apply a pre-equalizing to compensate sound reproduction for the coloration introduced by the listening room, or rather by an interaction between the loudspeaker and the listening room. Different approaches have been made to provide an improved sound reproduction quality with a more neutral timbre when listening to a loudspeaker in a given position in a given room.

Prior art solutions include methods based on a measurement of transfer characteristics from the loudspeaker to the listening position and then designing a filter compensating for this transfer characteristic. This has a number of well-known disadvantages such as uncontrolled high gains at specific low frequencies due to the presence of room modes, unless a number of additional modifications are performed. Still, these type of equalizing methods may result in a sound reproduction outside the listening position which has a more severe coloration than without the equalizing. Even very small movements outside the listening position, such as few centimetres, may in some cases be enough to degrade the perceived sound quality significantly. An example of a single point equalizing approach can be seen in U.S. Pat. No. 4,458,362.

As an alternative, several prior art methods suggest averaging transfer characteristics measured in a number of positions in the vicinity of the listening position so as to provide an equalizing which will provide satisfactory results for a larger listening area. However, such methods often require a quite large number of measurements, and still provide quite poor results when a listener moves outside a quite narrow listening area. Thus, in order for such methods to work in general, a large number of manual corrections are needed by a skilled operator. An example of a multi-point equalizing approach can be seen in U.S. Pat. No. 6,760,451.

Still other equalizing methods exist that are based on estimating a general acoustic response from the loudspeaker in the room, i.e. away from the listening position. This can either be done by averaging measurements performed in a number of positions in the room, or alternatively by measuring a power output from the loudspeaker or an equivalent acoustic parameter such as radiation resistance as described in EP 0 772 374 B1.

SUMMARY OF THE INVENTION

It is an object of the present invention to provide a method and a system for equalizing a loudspeaker in order to compensate for an influence of the room in which it is positioned, so as to improve a perceived sound reproduction quality for a person listening to the loudspeaker at a listening position in the room. Still, the method should provide an equalizing of the loudspeaker so that sound reproduction quality is improved also for listeners outside the listening position. The method must be suited for an automatic filter design with only very limited tasks required for a non-skilled operator with a high probability of a successful result. Hereby, the method is suited for use in a hi-fi system to be operated by a normal non-skilled person to equalize a hi-fi loudspeaker to a specific position in a living room while still taking into account individual acoustic properties of the room and its interaction with the loudspeaker.

In a first aspect the invention provides a method for equalizing a first loudspeaker positioned in a room in order to compensate for an influence of the room, the method comprising the steps of 1) measuring a listening position transfer function from electrical input of the first loudspeaker to a sound pressure at a listening position in the room,
2) determining a global transfer function representing a spatial average of sound pressure level in the room generated by the first loudspeaker,
3) determining an upper gain limit as a function of frequency, the upper gain limit being based on an inverse of the global transfer function,
4) determining an equalizing filter based on an inverse of the listening position transfer function, wherein a gain of the equalizing filter is limited to a maximum gain in accordance with the upper gain limit, and
5) equalizing the first loudspeaker according to the equalizing filter.

In step 1) it is to be understood that the listening position transfer function can be performed by one single measurement in a preferred listening position in the room. Alternatively, the listening position transfer function can be measured in a number of positions spatially positioned around the listening position, including or not including the preferred listening position, but rather covering a listening area, e.g. a spatial averaging representing a transfer function for a listening area.

In the following description "gain", and "transfer function" are referred to as values represented on a dB magnitude scale, or an equivalent representation, and in general they are considered as being a function of frequency. Thus, a positive gain is understood to be an absolute gain of more than unity, and a negative gain is understood to be an absolute gain of less than unity. Correspondingly, an inverse of a transfer function corresponds to change of sign of its magnitude values in dB, e.g. if $G(f1)=3$ dB, then $1/G(f1)=-3$ dB. Correspondingly, an addition or subtraction of transfer functions are also understood to be manipulations to be carried out on dB magnitudes.

With the method according to the first aspect, it is possible to equalize the first loudspeaker to the listening position but still taking into account the general properties of the room. Even though the equalizing filter is based on a measured transfer function to a specific listening position, the introduction of the frequency dependent upper gain limit based on an inverse of a transfer function representing an average sound pressure in the room, it is possible to shape the equalizing filter according to the general acoustic properties of the room since these properties are inherent in the global transfer function.

With the method, it is possible to adapt the equalizing filter to the listening position while still modifying the maximum gain of the filter to follow the general character of the room. Thus, it is possible to avoid designing an equalizing filter with high maximum gains at narrow frequency intervals dictated by local properties in the listening positions. According to the method, such high maximum gains would only be allowed in case they correspond to a general trend in the room. Hereby, the upper gain limit serves to solve the problem of a high gain at specific narrow frequency ranges, e.g. due to a local node in a narrow frequency range in the listening position caused by room mode. The absence of high maximum gains, especially at low frequencies, helps to save power amplifier and loudspeaker dynamic headroom. In addition, it provides a better match to a larger listening area since the specific local acoustic character of the listening position is reduced. Altogether, according to the method it is possible to provide a room adaptation filtering of a loudspeaker which will provide a listener with a listening experience where severe coloration due to room-loudspeaker interaction has been significantly reduced and still without introducing coloration artifacts in locations outside the listening position.

The method of the first aspect is possible to carry out for a non-skilled operating person, since it is possible to implement the method in an automatic version where the operator is instructed to perform different steps relating to measurement of the listening position transfer function and the determination of the global transfer function. The operator can be instructed by text instructions on a display or by means of synthesized voice instructions. The instructions may be such as: "Connect the microphone plug to the microphone input and position the microphone at your preferred listening position. Press "OK" when the microphone is in the listening position". Steps 1) and 2) need some involvement of the operator of the system, but steps 3) and 4) can be performed automatically by computer algorithms. Steps 3) and 4) may of course also be performed with more or less involvement of a skilled operator who may want to manipulate the filter design in response to e.g. graphs showing measured transfer functions or graphs showing target filter functions etc.

Depending on the choice of how the upper gain limit is based on the global transfer function and how the equalizing filter is based on the listening position transfer function, it is possible to provide an equalizing filter which is a) rather focused on the specific listening position or b) rather non-focused and more generally adapted to the properties of the room.

Even though numbered 1)-5) it is appreciated that several of the steps can be performed in a different order, e.g. step 1) may be performed after steps 2) and 3) etc. Step 5) is to be seen as an optional step since it is not necessarily carried out in close relation to steps 1)-4) relating to design of the equalizing filter.

The global transfer function of step 2) may be determined in different ways, such as preferably:

A) the global transfer function is calculated based on a measurement of acoustic power output from the first loudspeaker and data regarding sound absorption properties of the room, or B) the global transfer function is based on an average of at least two field point transfer functions measured from electrical input of the first loudspeaker to sound pressures at respective field point positions scattered across the room.

In A) an acoustic power measurement on the loudspeaker is required, e.g. using sound intensity technique. In addition, sound absorption data of the room are required, e.g. based on reverberation time measurements in the room or based on the room dimensions and information regarding sound absorbing materials in the room.

In B) the global transfer function is measured directly, and thus it includes all relevant information about the acoustic properties of the room provided that the field points are selected in a manner to properly reflect an average sound pressure in the room generated by the first loudspeaker. Since the listening position transfer function should also be measured, then measurement equipment, such as microphone and data processing means, must be available to perform the method on-site, and field point transfer functions used to determine the global transfer function may be performed using the same equipment. The global transfer function is preferably based on an average of at least three field points transfer functions measured from electrical input of the first loudspeaker to sound pressures at respective field point positions in the room. To achieve a more precise global transfer function, it may be based on an average of at least six field points transfer functions measured from electrical input of the first loudspeaker to sound pressures at respective field point positions in the room. In general, more field points lead to an improved result, however at the cost of more comprehensive measurements. It has been found, however, that two field point measurements provide satisfactory results.

In a preferred embodiment, wherein the global transfer function is based on an average of at least one field point transfer function measured from electrical input of the first loudspeaker to a sound pressure at a field point position in the room, together with the listening position transfer function. Thus, the measurement performed in the listening position, which should always be performed, is utilized also to provide information about the general acoustic properties of the room. In this case, only one additional field point transfer function is required to provide a satisfactory result which will still benefit from the upper gain limit based on the global transfer function.

In another preferred embodiment, the global transfer function is based on an average of at least two field point transfer functions measured from electrical input of the first loudspeaker to respective sound pressures at field point positions scattered across the room, together with the listening position transfer function.

Preferably, the averaging of transfer functions involved in calculating the global transfer function is a power averaging, such as a simple power type of averaging where all individual transfer functions to be averaged are weighted equally. However, it may be preferred to apply a different weight for the case where the listening position transfer function is included in the averaging to form the global transfer function.

In general, it is preferred that the at least two field point transfer functions are randomly selected within the room. Preferably, this includes selecting each of the at least two positions on a completely random basis within the boundaries of the room. The random selection of field points may e.g. be based on an input from a random number generator selecting the positions randomly in three dimensions based on pre-input dimensions of the room.

In addition to the upper gain limit, the method preferably includes determining a lower gain limit as a function of frequency based on an inverse of the global transfer function, and wherein a gain of the equalizing filter is limited to a minimum gain in accordance with the lower gain limit. Thus, together the upper and lower gain limits provide a gain envelope within which the gain of the equalizing filter is restricted. Since both upper and lower gain limit are based on the global transfer function, it is possible to provide gain limit restrictions to the equalizing filter that serves to adapt the resulting equalizing filter to the general acoustic properties of the room, rather than reflecting the specific local properties in the listening position. Especially, the lower gain limit serves to ensure that a peak in the frequency domain observed in the listening position transfer function will not be allowed to have full effect as a corresponding dip in the resulting equalizing filter, unless the peak observed in the listening position reflects a general trend in the room.

The upper gain limit is preferably determined as an inverse of the global transfer function plus a first positive gain, such as a positive gain of 3 dB, or alternatively the first positive gain being simply 0 dB. The first positive gain may be frequency independent or frequency dependent. Correspondingly, the lower gain limit is determined as an inverse of the global transfer function minus a second positive gain, such as a second positive gain of 3 dB. The second positive gain may be frequency independent or frequency dependent. These ways of providing different upper and lower gain limits based on the global transfer functions and addition/subtraction of gains can be used to provide more or less strict envelopes within which the gain of the equalizing filter is allowed.

The upper gain limit may be restricted to a first gain interval, such as an interval of 0 dB to +10 dB, the first gain interval being frequency independent or frequency dependent. Correspondingly, the lower gain limit may be restricted to a second gain interval, such as an interval of −15 dB to +10 dB, the second gain interval being frequency independent or frequency dependent.

By these restriction intervals it is possible to further refine the envelope within which the equalizing filter is restricted. This enables, e.g. together with the above-mentioned first and second gains, implementation of an automatic algorithm that will result in a satisfactory equalizing filter without the need for manual assistance from an operator, also in unusual room loudspeaker configurations.

Depending on the chosen frequency resolution on measured transfer functions it may be preferred to include performing a smoothing procedure on one or more transfer functions during the various steps of the method. The method includes performing a smoothing procedure on the global transfer function, such as performing the smoothing procedure on the global transfer function prior to performing step 3). The method may include performing a smoothing procedure on the listening position transfer function, such as performing the smoothing procedure on the listening position transfer function prior to performing step 4). The method may include performing a smoothing procedure on a transfer function based on a difference between the listening transfer function and the global transfer function. The method may include performing a smoothing procedure on a target filter function prior to implementing an equalizing filter based thereon.

Preferably, the method comprises aligning a level of the global transfer function to a level of the listening position transfer function, prior to performing step 4). Hereby, it is possible to automatically compensate for unwanted difference in measurement equipment gain settings etc. which may have been changed between measurement in field points and in the listening position, and also a general level difference between the listening position and global transfer functions caused by the fact that the sound pressure level in the listening position is most often higher than an average sound pressure level of the room since the loudspeaker is often placed near the listening position. The level alignment may be performed based on respective average levels of the global transfer function and the listening position transfer function, the respective average levels being calculated within a predetermined frequency interval, such as a frequency interval of 300 Hz to 800 Hz. A common average level of the global transfer function and the listening position transfer function may be found by the level alignment and this common level may be used as levels for determining inverse versions of the global transfer function and the listening position transfer function to be used in steps 3) and 4).

A filter may be applied to the global transfer function prior to performing step 3). The filter preferably serves to remove a general 'room gain' towards lower frequencies, e.g. below 200 Hz. Alternatively or additionally the filter may be arranged to remove an influence of a directivity of the first loudspeaker, this influence being such as a decreasing level towards higher frequencies and thus compensate for the fact that the loudspeaker will in many listening setups be directed with its acoustic high frequency driver pointing towards the listening position, thus causing a higher level at high frequencies here than in the room in general.

A filter may be applied to the listening position transfer function prior to performing step 4). The filter may serve the same purposes as mentioned in the above paragraph regarding the optional filter to be applied to the global transfer function, i.e. remove a general 'room gain' towards lower frequencies and/or compensate for a non-flat or non-uniform frequency response towards higher frequencies.

A filter may be applied to at least the listening position transfer function prior to performing step 3), so as to remove a general high-pass effect, such as a high-pass effect introduced by the first loudspeaker. A similar filter may be applied also to the global transfer function. An improved design of the equalizing filter is obtained when the natural cut-off inherent in the loudspeaker is removed prior to performing the filter design.

The equalizing filter is preferably a minimum phase approximation or a linear phase approximation of a target filter function.

Preferably, at least one of the listening position transfer function and a field point transfer function is measured by applying an electrical test signal, such as a random noise signal or a pure tone signal, to the first loudspeaker, and collecting a corresponding acoustic response in the room.

In embodiments of the method for e.g. a stereo pair of loudspeakers, the method includes determining a second equalizing filter for a second loudspeaker positioned in the room, and equalizing the second loudspeaker according to the second equalizing filter. The listening position transfer function and/or field point measurement may be performed by simultaneously applying electrical test signals, preferably identical electrical test signals, to the first and second loudspeakers, and collecting a corresponding acoustic response in the room. In a similar manner, field point transfer functions may be measured with simultaneous test signals applied to both loudspeakers. Hereby, the acoustic contributions from both loudspeakers are included in a single measurement.

Alternatively, the listening position transfer function measurement is performed separately for the first and second loudspeakers. For this case, the separately measured transfer function for the first and second loudspeakers may be summed to form a common listening position transfer function for the first and second loudspeakers, so as to mathematically sum the acoustic contribution from both loudspeakers using superposition. Corresponding to this alternative, a similar procedure may be followed for measurement of field point transfer functions.

It may be preferred to design the first and second equalizing filters to have identical transfer characteristics, thus facilitating the filter design procedure.

In embodiments of the method for e.g. a multi-loudspeaker listening setup for surround sound, such as a 5.1 loudspeaker setup, the method may include determining a plurality of equalizing filters for respective plurality of loudspeakers positioned in the room, and equalizing the plurality of loudspeakers according to the respective plurality of equalizing filters. The listening position transfer function measurement may be performed by simultaneously applying electrical test signals, preferably identical electrical test signals, to the plurality of loudspeakers, and collecting a corresponding acoustic response in the room. Alternatively, the listening position transfer function measurement is performed separately for at least two of the plurality of loudspeakers, such as separately for all of the plurality of loudspeakers. As will be appreciated, similar measurement methods may be used for field point transfer function measurements.

The listening position transfer function may alternatively be performed by a combination of simultaneously applying electrical test signals to a first subset of the plurality of loudspeakers, while separate measurements are performed on a second subset of the plurality of loudspeakers. A corresponding alternative for field point measurements may also be used.

More alternatively, the listening position transfer function may be performed by simultaneously applying electrical test signals to a first subset of the plurality of loudspeakers and separately, applying electrical test signals to a second subset of the plurality of loudspeakers. A corresponding alternative for field point measurements may also be used.

For all embodiments described, all measured transfer functions preferably have a frequency resolution equivalent to 1/12-octave or better than that. The method is preferably applied within the entire audio frequency range, but it may be applied only in a limited part thereof, e.g. the range 20-5,000 Hz or 20-1,000 Hz, the equalizing filter being designed to have a flat magnitude versus frequency characteristics in the remaining part of the audio frequency range.

In a second aspect, the invention provides a computer readable program code adapted to perform the method of the first aspect. The program code being present either on a data carrier, e.g. memory card, disk, harddisk, Read Only Memory, Random Access Memory etc. The program code may be adapted for execution on a general purpose device such as a personal computer or a dedicated device such as a measurement device or an audio device.

The same advantages as mentioned for the method of the first aspect also apply to the program code of the second aspect.

In a third aspect, the invention provides a system adapted to perform the method according to the first aspect, the system comprising measurement system adapted to perform the steps 1)-4) of the first aspect, and filter means adapted to perform step 5) of the first aspect.

The same advantages as mentioned for the method of the first aspect also apply to the system of the third aspect.

In an embodiment, the measurement system and the filter means are implemented as separate units adapted for interconnection via an interface. At least one of the separate units may be a stand-alone device.

In an alternative embodiment, the measurement system and the filter means are integrated into one unit. The one unit may be implemented as a circuit board adapted for insertion into an audio amplifier or another audio device. The one unit may alternatively be a stand-alone device, such as a device adapted for connection to a conventional hi-fi system.

The measurement system may be implemented as a computer, such as a personal computer, with an interface adapted to download filter coefficients to the filter means according to the equalizing filter.

In a fourth aspect, the invention provides an audio device comprising at least one of the measurement system and the filter means according to the third aspect. The audio device may comprise both of the measurement system and the filter means. The audio device may be such as an amplifier, a surround sound receiver etc.

The same advantages as mentioned for the method of the first aspect also apply to the system of the fourth aspect.

BRIEF DESCRIPTION OF THE DRAWINGS

In the following the invention is described in more details with reference to the accompanying figures, of which

Figure 1:
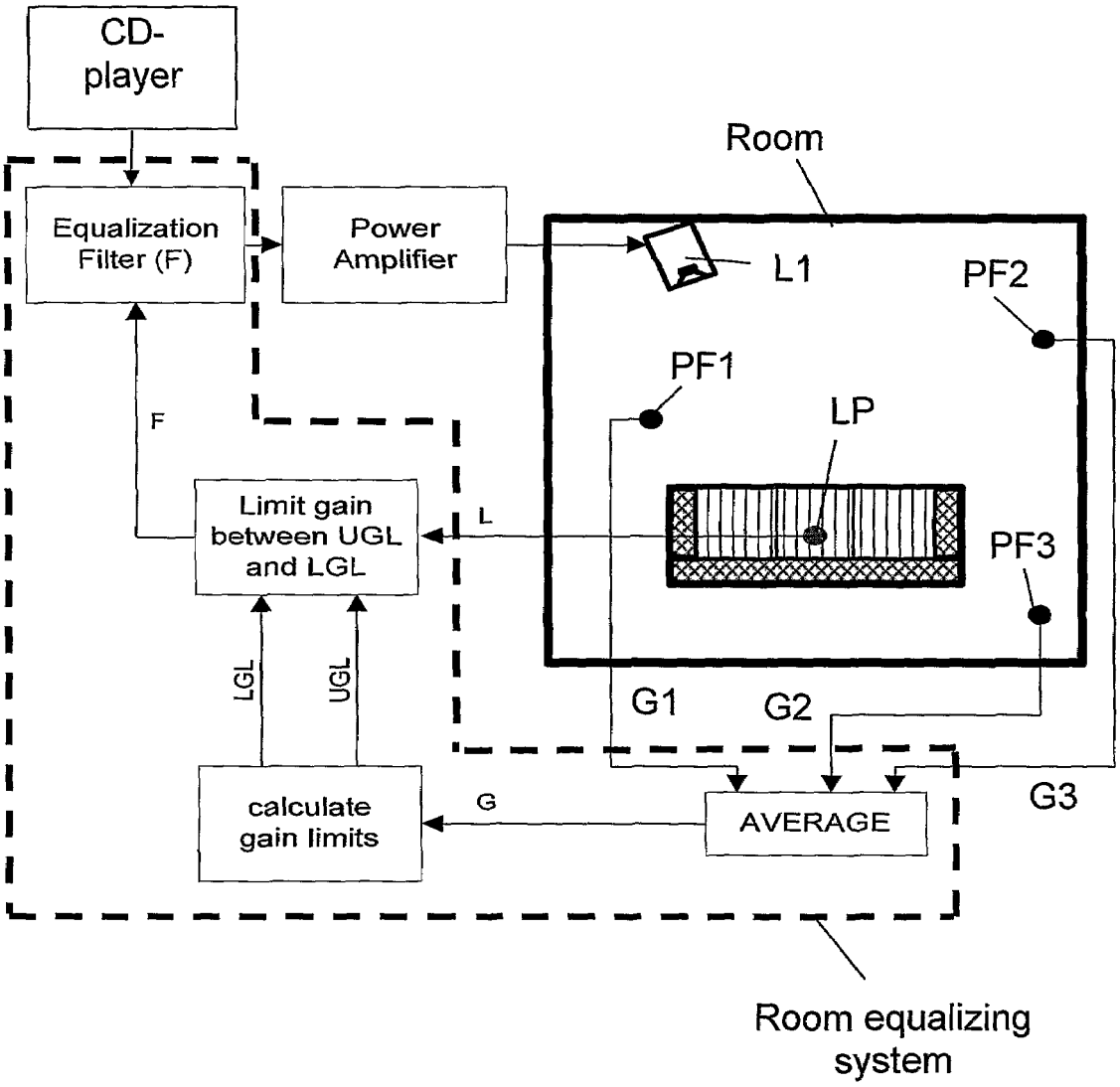
FIG. 1 illustrates basic parts of a room equalizing system according to the invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF PREFERRED EMBODIMENTS

FIG. 1 serves to illustrate basic elements of a preferred embodiment of the invention. A loudspeaker L1 is positioned in a room, e.g. a living room, with a listening position LP. The loudspeaker L1 may be part of a normal hi-fi stereo setup, such as illustrated by the power amplifier and CD-player connected to the loudspeaker L1. As illustrated, an equalizing filter F, i.e. a pre-filter, according to the invention is inserted in the playback chain between signal source (CD-player) and power amplifier with the main purpose of at least partly compensating sound reproduction in the listening position LP for an influence of the room, or rather an influence from the acoustic interaction between loudspeaker L1 and the room.

As illustrated, inputs to the room equalizing system are: a) a measured transfer in the listening position transfer function L from electrical input of the loudspeaker L1 to a sound pressure at the listening position, and b) a global transfer function G representing a spatial average of sound pressure level in the room generated by the loudspeaker L1. In the illustrated embodiment, the global transfer function G is based on an average, preferably a power average, of three field point transfer functions G1, G2, G3 measured from electrical input of the loudspeaker L1 to sound pressures at respective field point positions PF1, PF2, PF3 scattered across the room—i.e. the field points should not be scattered only around LP but rather cover the entire room. Thus, the global transfer function G serves to reflect a general acoustic trend or character of the room, while the listening position transfer function L includes a precise acoustic character of the listening position LP.

In order to provide a complete compensation in the listening position LP, the equalizing filter F should be designed based on a target filter function equal to 1/L. However, in practice a person—or more persons—listening to the loudspeaker L1 will not be positioned in one single point. In addition, choosing 1/L as target filter function would in general lead to infinite gain in narrow frequency bands at low frequencies due to room modes. These problems are solved by the invention by modifying the target 1/L by introducing an upper gain limit UGL as a function of frequency, and optionally also a lower gain limit LGL as a function of frequency, these gain limits being based on 1/G. Afterwards, the equalizing filter F is designed based on 1/L but where a gain of the F is limited to a maximum gain in accordance with UGL, and optionally with the further restriction that F is limited to a minimum gain in accordance with LGL.

Hereby, an equalizing filter F is obtained that compensates specific characteristics of the listening position but is restricted to compensate for characteristics that are general for the room. The resulting equalizing filter F will allow a perceived good effect also for listening in positions outside but near the listening position LP, and the filter F will also provide advantageous effects in positions far from the listening position LP.

The electro-acoustic transfer functions L, G1, G2, G3 can be measured in a known manner using a microphone and measurement methods known in the art of acoustic measurement technique may be used, e.g. pseudo random noise based methods, such as Maximum Length Sequence techniques, or Time-Delay Spectrometry.

In a preferred transfer function measurement method, simultaneous pure tones at 1/12-octave spaced frequencies in the frequency range 20-20,000 Hz are used. Goertzel analysis filters are preferably used, and the pure tone frequencies are selected such that is they precisely match frequency taps of the analysis filters.

The field point transfer functions G1, G2, G3 are preferably measured in randomly selected field points PF1, PF2, PF3 scattered across the room, i.e. randomly chosen positions with respect to both height, width and length dimensions of the room.

Better results can be obtained if more field points are used, but in general only two field points are needed to obtain acceptable results—especially if L is also included in the averaging together with the field point transfer functions to form G. In this case acceptable results can be obtained using a total of three microphone positions.

As an alternative to measuring field point transfer functions G1, G2, G3, it is possible to calculate G based on a measurement of acoustic power output from the loudspeaker L1 in the specific position in the room, e.g. using sound intensity measurement techniques, together with data regarding sound absorption properties of the room. The sound absorption properties of the room can either be calculated based on sound absorption data for sound absorbing materials in the room, or the sound absorption properties can be based on measured data, e.g. by reverberation time measurements in the room.

Practical implementations of the room equalizing system may take several forms, as already addressed. One embodiment suited for an existing hi-fi system may be formed by two separate units: a measurement unit and a filter unit with an interface to the measurement unit adapted to receive filter coefficients from the measurement unit.

The measurement unit is then preferably designed to handle transfer function measurements and filter design, and thus preferably including signal processing means to perform transfer function measurements in a dialog with a user in order to instruct the user to place a measurement microphone in proper positions and ensure that all electrical connections are correct etc. Preferably, error handling algorithms are included in order to verify if measurement results seem to be acceptable or need to be repeated, i.e. to ensure a waterproof automatic procedure. In addition, the measurement unit preferably further includes an automatic algorithm to be able to perform the design of the filter F without any manual interaction required by the user. The measurement unit may be a stand alone device or it may be formed by a normal personal computer with an audio processor card.

To suit a normal hi-fi system the filter may be a stand-alone unit to be included between signal source (e.g. CD-player) and an amplifier, or between pre-amplifier and power amplifier. The filter may be adapted to receive either an analog or digital input audio signal, and it may be adapted to either filtered output in a digital or an analog format. Preferably, the equalizing filtering is implemented by means of a FIR or an IIR filter.

In case of an amplifier with digital signal processing means, the amplifier may be adapted to load filter coefficient from a measurement system.

Figure 2:
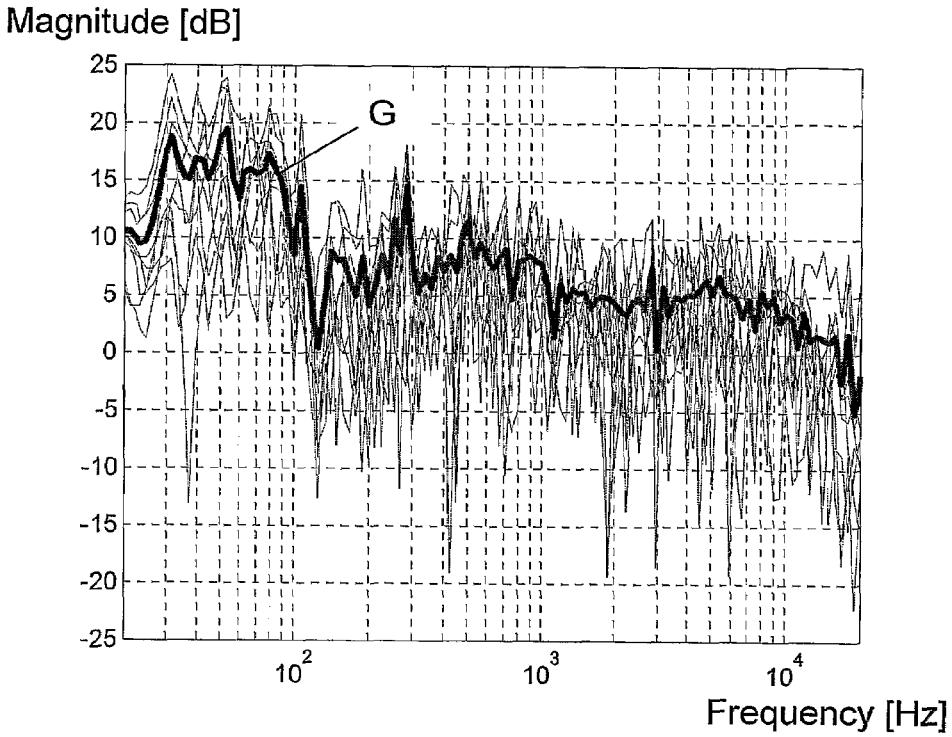
FIG. 2 shows graphs with examples of 9 measured transfer functions measured in a room (thin lines). In upper graph a global transfer function G being a power average of the 9 measured transfer functions is shown with a bold line, and in lower graph the listening position transfer function L is shown for comparison with a bold line, FIG. 3, upper part, shows the global transfer function G (bold curve) with a horizontal line indicating an average level of the global transfer function G in frequency interval 300-800 Hz, and a sloping line indicating a general decreasing level towards higher frequency of G, and lower part shows a compensated version of G' (bold curve)
Figure 2:
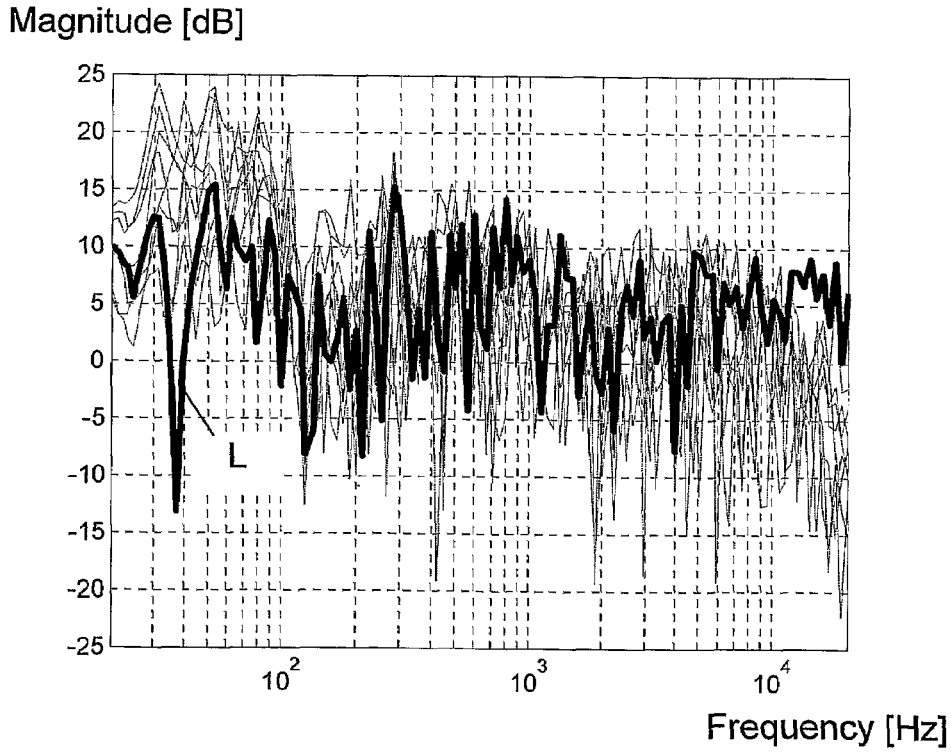

FIG. 2, upper graph, illustrates an example of a magnitude versus frequency plot of 9 measured field point transfer functions and the global transfer function G (bold line) calculated as a power average thereof. As seen, the 9 field point transfer functions are rather different and they include highly individual peaks and dips. The calculated G is much smoother and merely reflects general characteristics of the individual field points. Note e.g. that there is a general lift in the range 30-100 Hz of 10-15 dB relative to the level at 500-1,000 Hz.

Lower graph of FIG. 2 shows the same field point transfer functions as in the upper graph but here the listening position transfer function L is shown with a bold line. Comparing L with G it is noticed that L has a severe dip in a narrow frequency band slightly below 40 Hz. Thus, using 1/L as a filter target would result in a large gain around 40 Hz thereby requiring a considerable dynamic headroom of power amplifier and loudspeaker and still, since the dip in L is caused by a room mode, an optimal acoustic response in the listening position LP would not be obtained.

Figure 3:
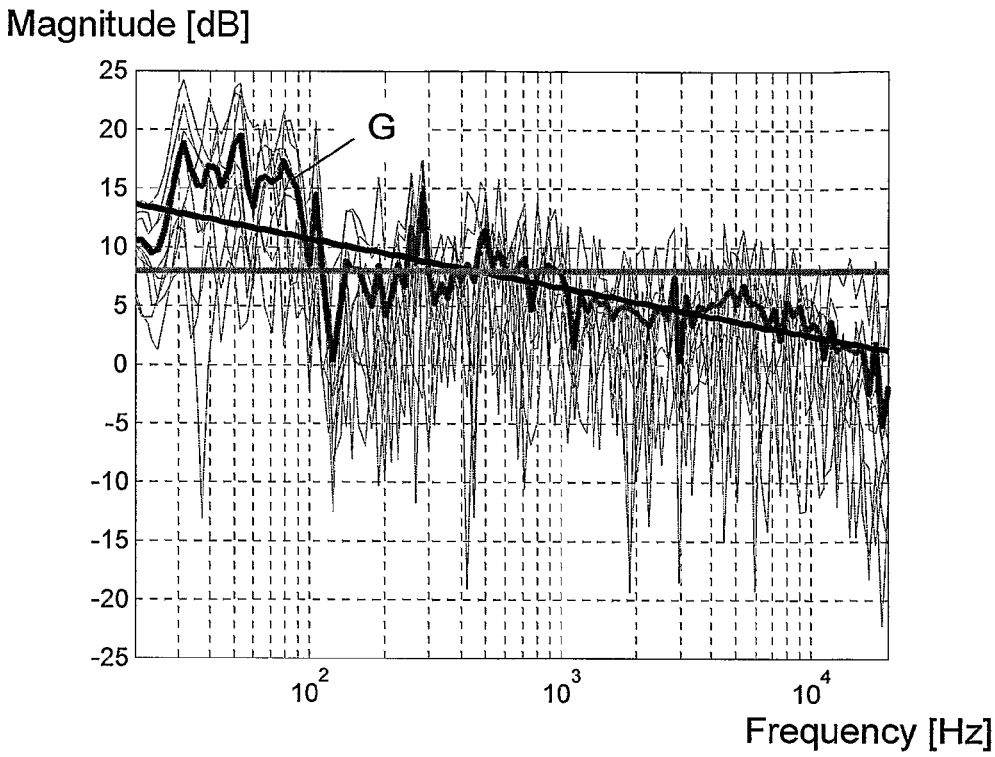
Figure 3:
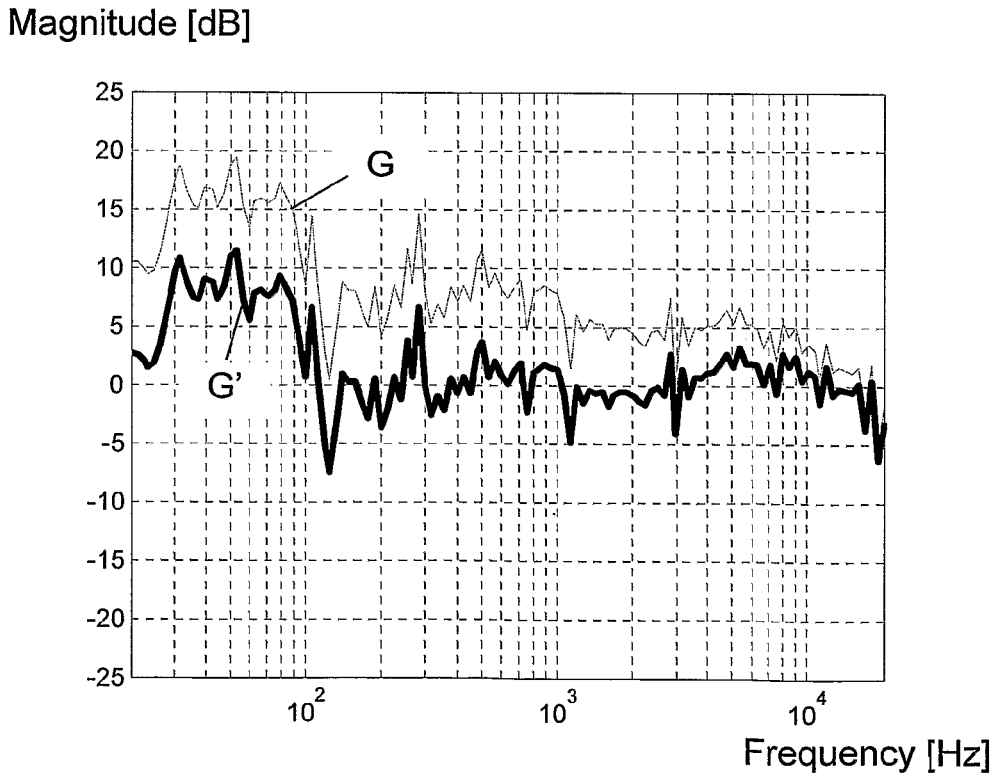

FIG. 3 illustrates preferred compensation techniques for modifying G prior to calculating UGL and LGL based thereon. Upper graph of FIG. 3 shows a horizontal line which indicates an average level of G calculated within a specific frequency interval, preferably the range 300-800 Hz, but other ranges may be equally well suited. The purpose is to determine a general level of G and to compensate therefore in order to obtain a compensated version G' being level offset so that it has a general gain of zero dB. Hereby, it is possible to provide an automatic method for calculating the equalizing filter F based on measurements that are not necessarily calibrated with respect to absolute level, and still resulting in F having a general gain of zero dB—i.e. without any frequency independent gain or attenuation which is generally not the intension with F.

Upper graph of FIG. 3 also shows a sloping line which indicates a general trend in G to decrease in level towards high frequencies. This can in general be expected due to a certain directivity of acoustic output from a loudspeaker, since a normal loudspeaker, e.g. for hi-fi use, often is designed to have a flat on-axis frequency characteristics, while an average sound power delivered to the room will drop at higher frequencies due to a non-spherical directivity pattern towards higher frequencies. Thus, G will most often have a general decreasing level that can be approximated by a straight sloping line, when viewed in a dB-magnitude versus logarithmic frequency graph. According to a preferred compensation method, a straight sloping line is calculated based on G, and G is then preferably compensated for this sloping effect above a cut-off frequency determined by an intersection between the horizontal line indicating the general level of G and the calculated straight sloping line.

Lower graph of FIG. 3 illustrates G' being a compensated version of G with respect to a general level and high frequency drop as described above. As seen, G' has a generally flat characteristics and a general zero dB level. Still, though, it is seen that G' has a gain of up to more than 10 dB in the range 30-80 Hz.

Figure 4:
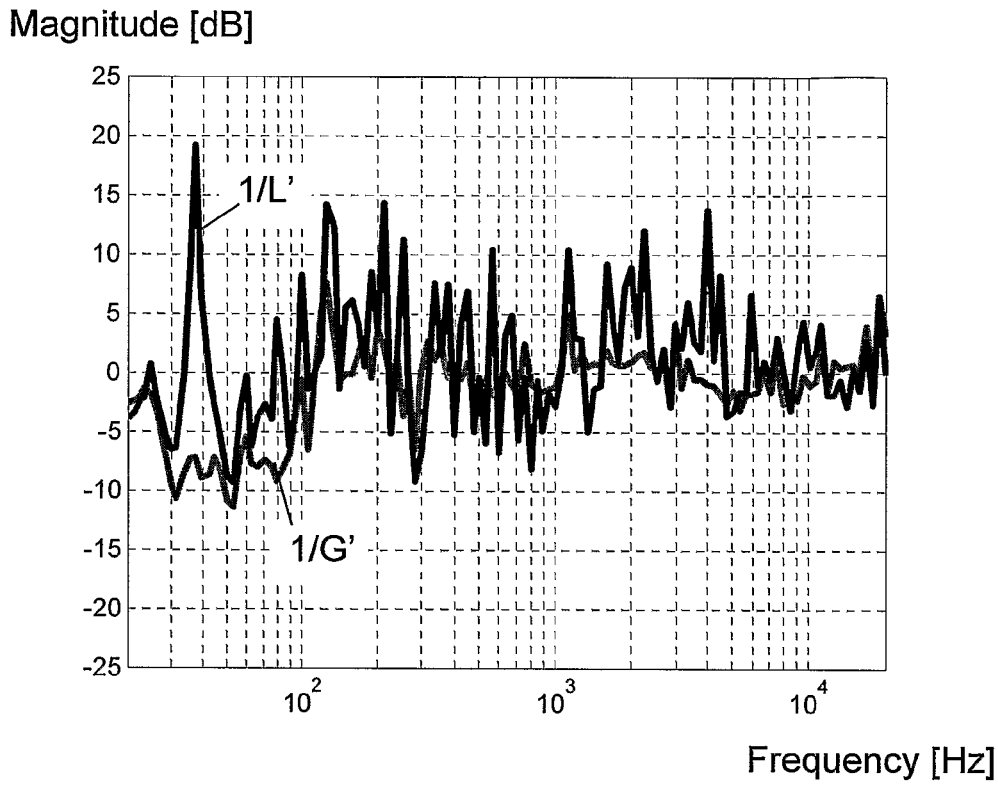
FIG. 4 shows inverse versions of the compensated global transfer function 1/G' and a compensated listening position transfer function 1/L', respectively, where L and G have been level aligned to match each other, FIG. 5, upper graph, shows examples of upper and lower gain limits UGL, LGL based on 1/G', and lower graph illustrates a target filter function T being a gain limited version of the inverse listening position transfer function 1/L'.

FIG. 4 illustrates an inverted version of the compensated global transfer function 1/G'. In addition, a correspondingly compensated listening position transfer function 1/L' is shown, where L' is a level offset version of L with a general gain of zero dB obtained with a method corresponding to the above explanation for G'. Thus, both of 1/G' and 1/L' have preferably a general gain of zero dB. Based on 1/G', an upper gain limit UGL and a lower gain limit LGL can now be calculated.

Figure 5:
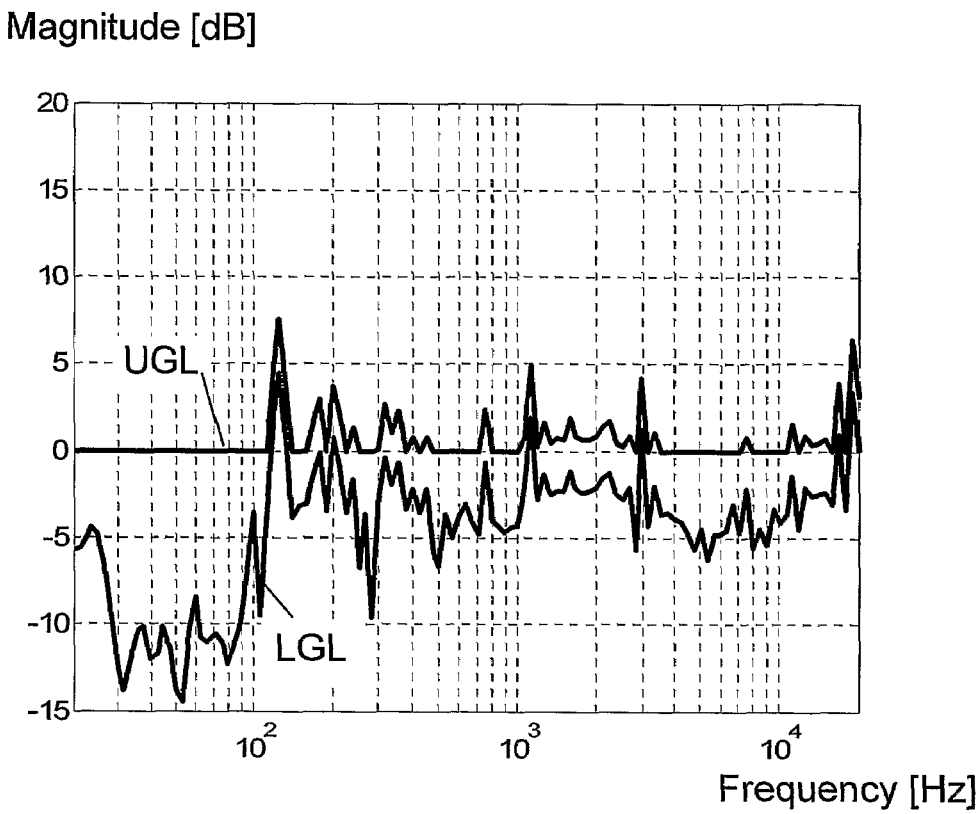
Figure 5:
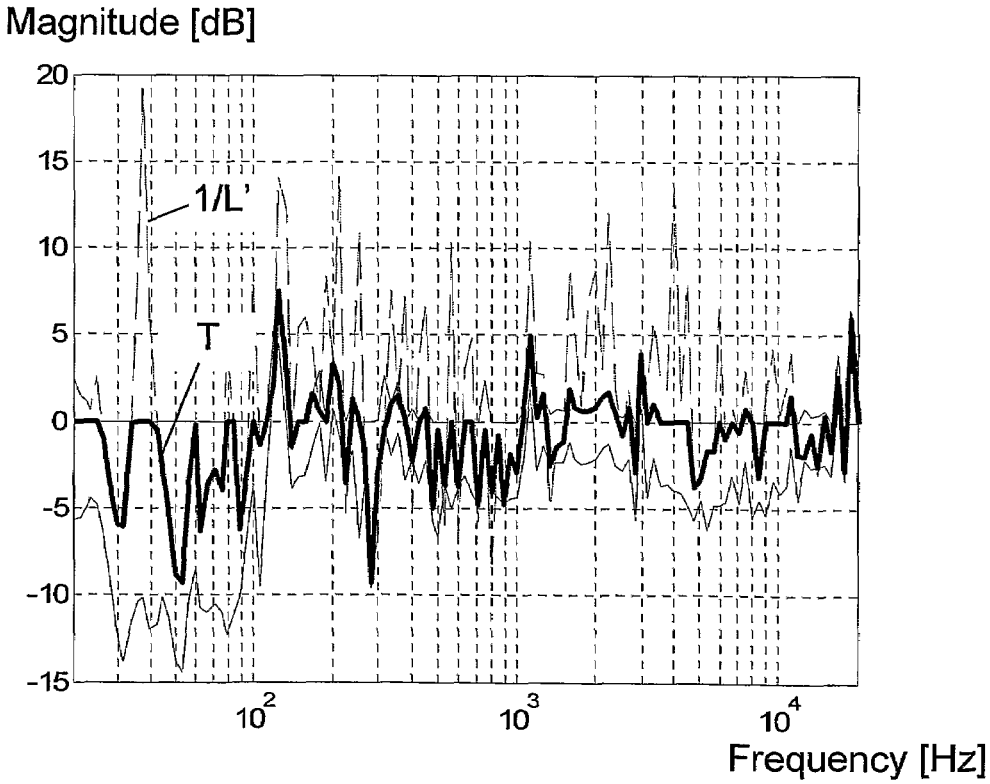

FIG. 5, upper part, shows examples of UGL and LGL based on 1/G' as shown in FIG. 4. UGL is set equal to 1/G' but restricted within a frequency independent a first gain limit interval gi1, here chosen to be the interval [0 dB to +10 dB]. In general, though, it can be chosen to set UGL=1/G'+g1, where g1 is a positive gain (in dB), e.g. can be chosen as g1=3 dB or g1=6 dB. In a preferred embodiment, g1=0 dB as also shown in the example of upper part of FIG. 5. Where UGL=1/G'+g1 is outside the interval gi1, UGL is set equal to an end of gi1 being closest to the gain of (1/G'+g1). Thus, in the example of FIG. 5, below 100 Hz where 1/G' (+0 dB) is below gi1 a lower end point of the gi1, here UGL is set equal to a lower end of gi1, i.e. 0 dB.

In a similar manner LGL is restricted within a frequency independent second gain limit interval gi2, here chosen to be the interval [−15 dB to +10 dB]. Within this interval LGL is set equal to 1/G'−3 dB, or in more general terms: LGL=1/G'−g2, where g2 is a positive gain (in dB), e.g. g2=0 dB or g2=3 dB. Thus, by the illustrated strategy of setting UGL=1/G' while setting LGL=1/G'−3 dB, a rather strict limit is put on a possible maximum gain of the resulting equalizing filter F, while it is allowed to have a minimum gain being smaller than dictated by 1/G'.

By a proper strategy for selection of g1, gi1, g2 and gi2, it is possible to adjust the resulting equalizing filter F between, in one end a general "room character" while in another end a more focused "listening position" character.

FIG. 5, lower part, shows a target function T for the equalizing filter F resulting from applying to 1/L' the gain limits UGL and LGL to determine maximum and minimum allowable gains as function of frequency as described. 1/L' is shown with thin line while the gain limited version T is shown with bold line. As seen, T does not suffer from narrow peaks with high gain values, especially it is seen that the peak in 1/L' just below 40 Hz has been suppressed since this peak is not present in 1/G', and consequently according to the described procedure, a high gain value has not been allowed in this frequency range since the peak is due to a local phenomenon in the listening position LP. On the contrary, a gain of 7 dB has been allowed in a narrow frequency band around 110-120 Hz since a peak in 1/G' is also found here, and thus this peak reflects a general characteristics of the room rather than being a local phenomenon in the listening position LP.

Figure 6:
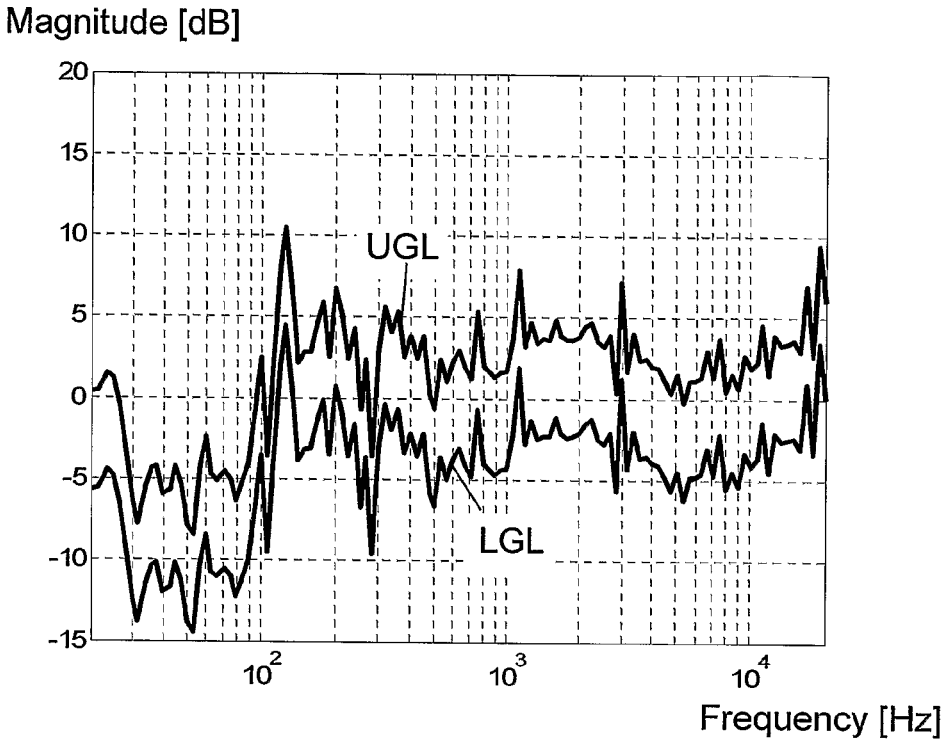
FIG. 6 shows the same as FIG. 5, but for another example of upper and lower gain limits UGL, LGL, thus resulting in a different target filter function T (lower graph)
Figure 6:
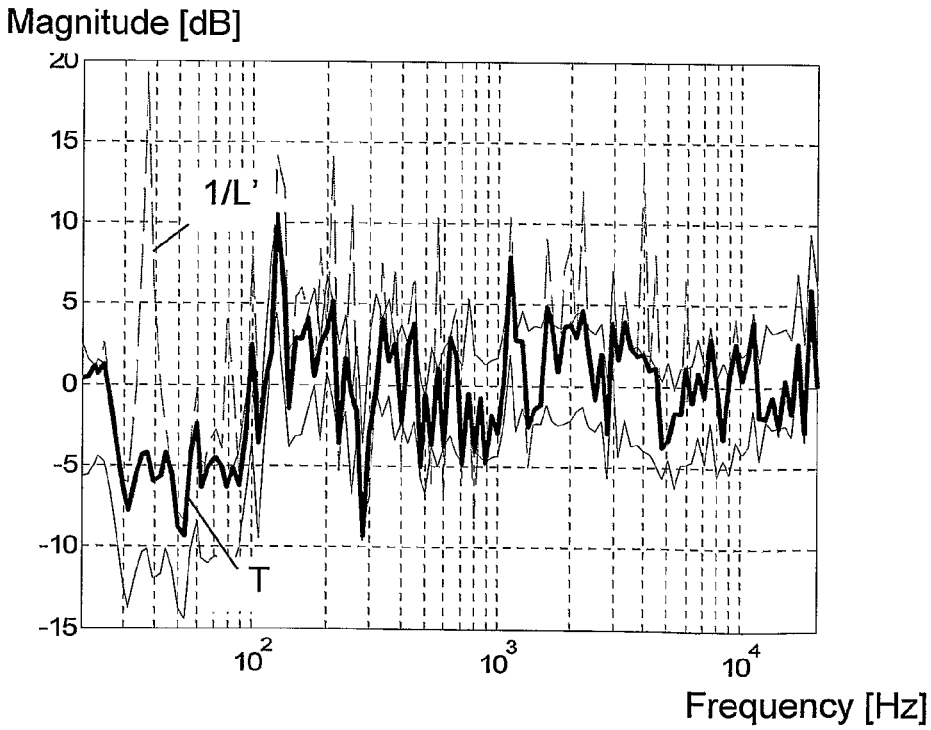

FIG. 6 show upper and lower graphs similar to those of FIG. 5, but for an alternative strategy of selecting UGL and LGL. Upper graph of FIG. 6 shows UGL=1/G'+3 dB, while LGL=1/G'−3 dB. I.e. compared to UGL and LGL of FIG. 5, no restriction interval has been applied. Lower part of FIG. 6 shows the resulting target filter function T (bold line) after the gain limits UGL and LGL of the upper graph have been applied to 1/L'. For comparison, 1/L' is shown with thin line. The resulting T is different from that of FIG. 5, but still they have a number of basic features in common, such as an absence of a gain peak in the range below 40 Hz in spite of 1/L' dictating that.

Figure 7:
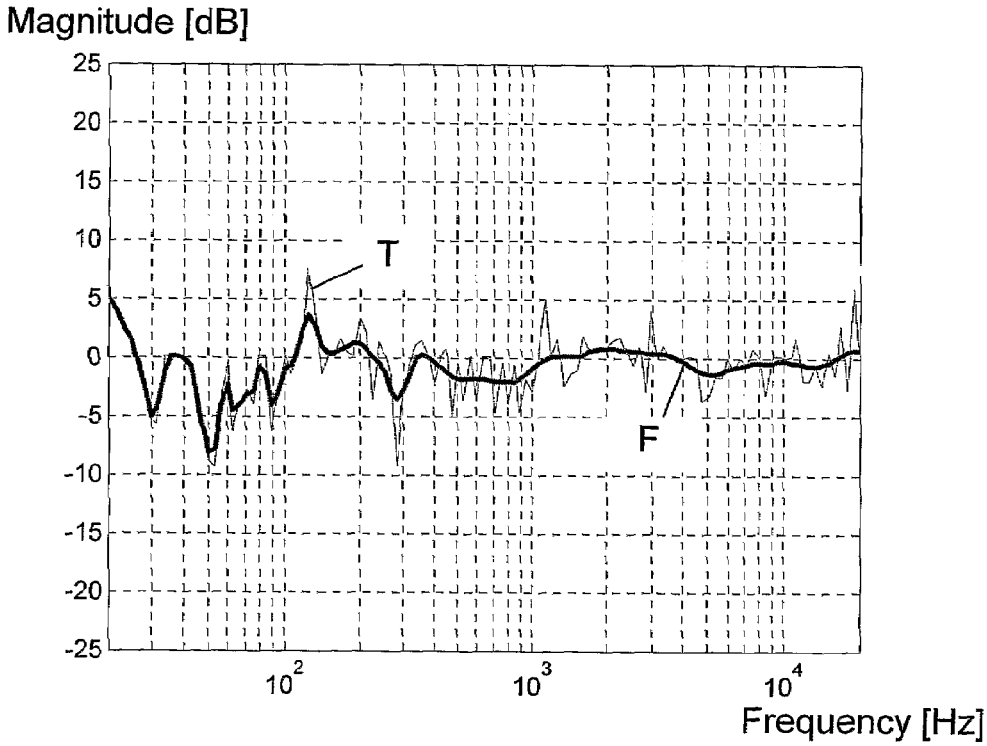
FIG. 7 illustrates, for the example of FIG. 5, the target filter function T and a smoothed version thereof which forms a transfer function to be implemented as the equalizing filter F.

FIG. 7 shows with thin line the target filter function T from lower graph of FIG. 5 together the final equalizing filter function F which, in preferred embodiments, is a smoothed version of T. One reason for smoothing is that the equalizing filter F can be approximated by a lower filter order and thus be implemented in a more efficient and by more economical means, still without any audible disadvantages.

Sound reproduction in a room will always result in an increased sound pressure level towards lower frequencies due to the nature of typical room, e.g. a normal living room, due to the fact that in a normal room, the amount of acoustic absorption is typically lower towards lower frequencies than at mid and high frequencies. The increased sound pressure level towards lower frequencies is perceived as natural to the human ear as this provides the listener a sense of actually being in a room. Consequently, to preserve a natural sound reproduction, it is preferred that a room equalizing system does not remove a smooth increase in level at low frequencies by providing a flat target response at low frequencies. Rather, it is preferred that the room equalizing system provides a target response where such natural smooth increase in level at low frequencies is preserved, and thus taking into account what can be referred to as a natural low frequency 'room gain'.

This preservation of the low frequency 'room gain' in the finally implemented equalizing filter function and thus in the reproduced sound, may be implemented by applying a filter as a function of frequency to the global transfer function serving to remove the low frequency 'room gain' and arrive at a modified global transfer function and then use this global transfer function to form the upper gain limit. In the same way, the listening position transfer function may be modified by applying a filter as a function of frequency serving to remove the low frequency 'room gain' and arrive at a modified listening position transfer function before determining the equalizing filter function based thereon. Alternatively, the low frequency 'room gain' may of course be implemented by estimating the 'room gain' from the measured transfer functions and adding this estimated 'room gain' to the equalizing filter prepared according to the general rules of the invention as already described, e.g. by modifying a final target function with this 'room gain' before implementing the equalizing filter function. More alternatively, a fixed filter may be applied finally in the process of implementing the equalizing filter function, the fixed filter with a predetermined filter function serving to preserve a predetermined 'room gain' which is not based on measurement results obtained in the actual room.

Figure 8:
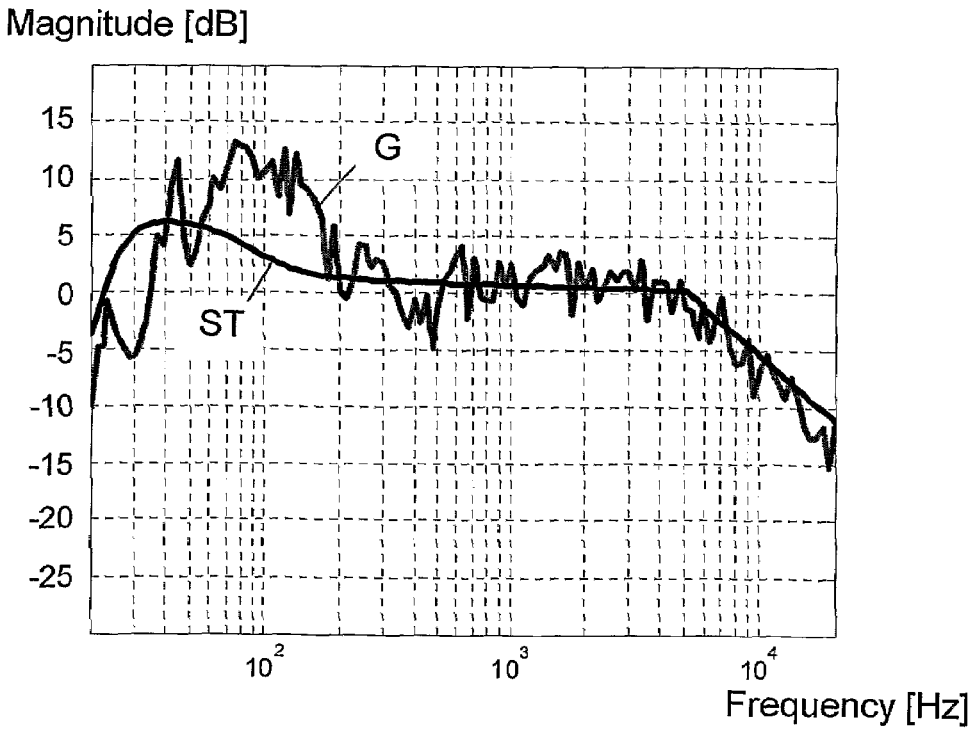
FIG. 8 illustrates an example of a preferred low frequency boost due to a general 'room gain' towards lower frequencies.

FIG. 8 shows an example of a preferred target function ST based on a global transfer function G measured in a typical listening room. As it is seen, the global transfer function G exhibits different general characteristics in different frequency ranges, caused by the nature of the room. At mid frequencies, i.e. 200-5000 Hz the global transfer function G has a general flat nature, and thus it is preferred in this frequency range to have a target ST which if generally flat, such as having a fixed gain at mid frequencies, e.g. a gain of zero dB). However, from FIG. 8 is seen that the ST curve actually has a slight tilt, such that the gain at 200 Hz is 1 dB or 2 dB higher than at 5 kHz. Above 5 kHz the global transfer function G has a general roll off of 6 dB per octave, and this is preferably adopted also in the target function ST.

Finally, the global transfer function G of FIG. 8 is seen to include the above-mentioned general low frequency lift, here below 200 Hz. In response to this general lift in the level below 200 Hz, the target function ST is chosen to preserve this general 'room gain' by a shallow gain of up to 6 dB with a maximum gain at about 30-50 Hz. As seen, it is not chosen to let the target function ST follow the level jump around 150-200 Hz in G, but rather the target function ST has a very smooth low frequency lift starting in the range 150-200 Hz with increasing gain towards lower frequencies, reaching a maximum gain level at the lowest audio frequency range. In preferred embodiments, the low frequency lift in the target function ST is based on a predetermined fixed filter function thus serving to provide the listener with a fixed and well-defined 'room gain' independent of the actual listening room, hereby avoiding the equalizing system to adapt to extreme low frequency gains in rooms exhibiting a very high low frequency gain. Such fixed 'room gain' may e.g. based on the properties of an IEC standard listening room. It is preferred to smoothly roll off the gain below a lower limit of the loudspeaker to avoid high gains at frequencies below the low frequency roll off for the loudspeaker, so as to save amplifier power and avoid large amplitudes of the woofer diaphragm.

The equalizing presented in the preferred embodiments is not focused on equalizing loudspeaker imperfections. However, such additional equalizing of loudspeaker imperfections may of course be included in the design of the equalizing filter F. Especially it may be desirable to add a moderate low frequency boost to compensate for a quite high cut-off frequency of small loudspeakers. Such low frequency boost is easily designed in connection with the method according to the invention, since the transfer function measurements of L and G include information about the low frequency cut-off frequency of the actual loudspeaker. Thus, it is possible to compensate therefor. However, as addressed earlier, it is preferred to initially remove such high-pass effect from the measured transfer functions prior to performing method step 3). The equalizing for this high-pass effect can then be applied after step 4), e.g. forming a combined filter F that both compensates for the interaction between room and loudspeaker and for the general high-pass effect of the loudspeaker.

It is to be understood that the described manipulations performed on L and G, i.e. level alignment, smoothing etc, may be performed before or after calculating the inverse of L and G, respectively. Thus, it is to be understood that e.g. smoothing may be applied either to G or to 1/G, or to 1/G plus a gain factor.

In the claims reference signs to the figures are included for clarity reasons only. These references to exemplary embodiments in the figures should not in any way be construed as limiting the scope of the claims.

The invention claimed is:

1. A method for equalizing a first loudspeaker (L1) positioned in a room in order to compensate for an influence of the room, the method comprising the steps of 1) measuring a listening position transfer function (L) from electrical input of the first loudspeaker (L1) to a sound pressure at a listening position (LP) in the room,
2) determining a global transfer function (G) representing a spatial average of sound pressure level in the room generated by the first loudspeaker (L1),
3) determining an upper gain limit (UGL) as a function of frequency, the upper gain limit (UGL) being based on an inverse of the global transfer function (G),
4) determining an equalizing filter (F) based on an inverse of the listening position transfer function (L), wherein a gain of the equalizing filter (F) is limited to a maximum gain in accordance with the upper gain limit (UGL), and
5) equalizing the first loudspeaker (L1) according to the equalizing filter (F).

2. Method according to claim 1, wherein the global transfer function (G) is calculated based on a measurement of acoustic power output from the first loudspeaker (L1) and data regarding sound absorption properties of the room.

3. Method according to claim 1, wherein determining the global transfer function (G) is based on an average of at least two field point transfer functions (G1, G2) measured from electrical input of the first loudspeaker (L1) to sound pressures at respective field point positions (PF1, PF2) scattered across the room.

4. Method according to claim 3, wherein the global transfer function (G) is based on an average of at least three field points transfer functions (G1, G2, G3) measured from electrical input of the first loudspeaker (L1) to sound pressures at respective field point positions (PF1, PF2, PF3) in the room.

5. Method according to claim 4, wherein the global transfer function (G) is based on an average of at least six field points transfer functions (G1, G2, G3) measured from electrical input of the first loudspeaker (L1) to sound pressures at respective field point positions (PF1, PF2, PF3) in the room.

6. Method according to claim 3, wherein the averaging of transfer functions involved in calculating the global transfer function (G) is a power averaging.

7. Method according to claim 3, wherein the at least two field point transfer functions (PF1, PF2) are randomly selected within the room, such as based on an input from a random number generator selecting the positions randomly in three dimensions based on pre-input dimensions of the room.

8. Method according to claim 1, wherein the global transfer function (G) is based on an average of at least one field point transfer function (G1) measured from electrical input of the first loudspeaker (L1) to a sound pressure at a field point position (PF1) in the room, together with the listening position transfer function (L).

9. Method according to claim 8, wherein the global transfer function (G) is based on an average of at least two field point transfer functions (G1, G2) measured from electrical input of the first loudspeaker (L1) to respective sound pressures at field point positions (PF1, PF2) scattered across the room, together with the listening position transfer function (L).

10. Method according to claim 1, further comprising the step of determining a lower gain limit (LGL) as a function of frequency based on an inverse of the global transfer function (G), and wherein a gain of the equalizing filter (F) is limited to a minimum gain in accordance with the lower gain limit (LGL).

11. Method according to claim 10, wherein the lower gain limit (LGL) is determined as an inverse of the global transfer function (G) minus a second positive gain (g2), such as 3 dB.

12. Method according to claim 11, wherein the second positive gain (g2) is frequency independent or frequency dependent.

13. Method according to claim 10, wherein the lower gain limit (LGL) is restricted to a second gain interval (gi2), such as an interval of −15 dB to +10 dB.

14. Method according to claim 13, wherein the second gain interval (gi2) is frequency independent or frequency dependent.

15. Method according to claim 1, wherein the upper gain limit (UGL) is determined as an inverse of the global transfer function (G) plus a first positive gain (g1), such as 3 dB.

16. Method according to claim 15, wherein the first positive gain (g1) is frequency independent or frequency dependent.

17. Method according to claim 1, wherein the upper gain limit (UGL) is restricted to a first gain interval (gi1), such as an interval of 0 dB to +10 dB.

18. Method according to claim 17, wherein the first gain interval (gi1) is frequency independent or frequency dependent.

19. Method according to claim 1, further comprising the step of performing a smoothing procedure on the global transfer function (G), such as performing the smoothing procedure on the global transfer function (G) prior to performing step 3).

20. Method according to claim 1, further comprising the step of performing a smoothing procedure on the listening position transfer function (L), such as performing the smoothing procedure on the listening position transfer function (L) prior to performing step 4).

21. Method according to claim 1, further comprising the step of performing a smoothing procedure on a transfer function based on a difference between the listening transfer function (L) and the global transfer function (G).

22. Method according to claim 1, further comprising a level alignment of a level of the global transfer function (G) to a level of the listening position transfer function (L), prior to performing step 4).

23. Method according to claim 22, wherein the level alignment is performed based on respective average levels of the global transfer function (G) and the listening position transfer function (L), the respective average levels being calculated within a predetermined frequency interval, such as a frequency interval of 300 Hz to 800 Hz.

24. Method according to claim 22, wherein a common average level of the global transfer function (G) and the listening position transfer function (L) found by the level alignment is used as levels for determining inverse versions of the global transfer function (G) and the listening position transfer function (L) to be used in steps 3) and 4).

25. Method according to claim 1, wherein a filter is applied to the global transfer function (G) prior to performing step 3).

26. Method according to claim 25, wherein the filter serves to remove an influence of a directivity of the first loudspeaker (L1), this influence being such as a decreasing level towards higher frequencies.

27. Method according to claim 25, wherein the filter serves to remove an increase in level towards lower frequencies due to a low frequency room gain.

28. Method according to claim 1, wherein a filter is applied to at least the listening position transfer function (L) prior to performing step 4).

29. Method according to claim 28, wherein the filter serves to remove a general high-pass effect, such as a high-pass effect introduced by the first loudspeaker (L1).

30. Method according to claim 28, wherein the filter serves to remove an increase in level towards lower frequencies due to a low frequency room gain.

31. Method according to claim 1, wherein determination of the equalizing filter (F) includes performing a minimum phase approximation or a linear phase approximation of a target filter function (T).

32. Method according to claim 1, wherein at least one of the listening position transfer function (L) and a field point transfer function (G1) is measured by applying an electrical test signal, such as a random noise signal or a pure tone signal, to the first loudspeaker, and collecting a corresponding acoustic response in the room.

33. Method according to claim 1, wherein determination of the equalizing filter (F) includes performing a smoothing procedure on a target filter function (T).

34. Method according to claim 1, wherein measuring the listening position transfer function (L) includes measuring sound pressure in one or more positions spatially located in a vicinity of the listening position (LP).

35. Method according to claim 1, further comprising the steps of determining a second equalizing filter for a second loudspeaker positioned in the room, and equalizing the second loudspeaker according to the second equalizing filter.

36. Method according to claim 35, wherein the listening position transfer function (L) measurement is performed by simultaneously applying electrical test signals, preferably identical electrical test signals, to the first (L1) and second loudspeakers, and collecting a corresponding acoustic response in the room.

37. Method according to claim 36, wherein measurements involved in forming the global transfer function (G) are performed by simultaneously applying electrical test signals, preferably identical electrical test signals, to the first (L1) and second loudspeakers, and collecting a corresponding acoustic responses in the room.

38. Method according to claim 35, wherein the listening position transfer function (L) measurement is performed separately for the first and second loudspeakers.

39. Method according to claim 38, wherein the separately measured transfer function for the first (L1) and second loudspeakers are summed to form a common listening position transfer function (L) for the first (L1) and second loudspeakers.

40. Method according to claim 35, wherein the first (F1) and second equalizing filters have identical transfer characteristics.

41. Method according to claim 35, further comprising the steps of determining a plurality of equalizing filters for respective plurality of loudspeakers positioned in the room, and equalizing the plurality of loudspeakers according to the respective plurality of equalizing filters.

42. Method according to claim 41, wherein the listening position transfer function (L) measurement is performed by simultaneously applying electrical test signals, preferably identical electrical test signals, to the plurality of loudspeakers, and collecting a corresponding acoustic response in the room.

43. Method according to claim 41, wherein the listening position transfer function (L) measurement is performed separately for at least two of the plurality of loudspeakers, such as separately for all of the plurality of loudspeakers.

44. Method according to claim 41, wherein the listening position transfer function (L) is performed by a combination of simultaneously applying electrical test signals to a first subset of the plurality of loudspeakers while separate measurements are performed on a second subset of the plurality of loudspeakers.

45. Method according to claim 41, where the listening position transfer function (L) is performed by simultaneously applying electrical test signals to a first subset of the plurality of loudspeakers and separately, applying electrical test signals to a second subset of the plurality of loudspeakers.

46. Computer readable program code adapted to perform the method of claim 1.

47. System adapted to perform the method according to claim 1, the system comprising measurement system adapted to perform the steps 1)-4), and filter means adapted to perform step 5).

48. System according to claim 47, wherein the measurement system and the filter means are implemented as separate units adapted for interconnection via an interface.

49. System according to claim 48, wherein at least one of the separate units is a stand-alone device.

50. System according to claim 47, wherein the measurement system and the filter means are integrated into one unit.

51. System according to claim 50, wherein the one unit is implemented as a circuit board adapted for insertion into an audio amplifier.

52. System according to claim 50, wherein the one unit is a stand-alone device.

53. System according to claim 47, wherein the measurement system is implemented as a computer, such as a personal computer, with an interface adapted to download filter coefficients to the filter means according to the equalizing filter (F).

54. Audio device comprising at least one of the measurement system and the filter means according to claim 47.

55. Audio device according to claim 54, the audio device comprising both of the measurement system and the filter means.

* * * * *